US010719028B2

(12) United States Patent
An et al.

(10) Patent No.: US 10,719,028 B2
(45) Date of Patent: Jul. 21, 2020

(54) PROCESS CARTRIDGE AND IMAGE FORMING APPARATUS

(71) Applicant: CANON KABUSHIKI KAISHA, Tokyo (JP)

(72) Inventors: Koji An, Tokyo (JP); Kazunari Hagiwara, Yokohama (JP); Takuya Kitamura, Yokohama (JP); Takashi Hiramatsu, Tokyo (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/534,133

(22) Filed: Aug. 7, 2019

(65) Prior Publication Data

US 2020/0050126 A1 Feb. 13, 2020

(30) Foreign Application Priority Data

Aug. 10, 2018 (JP) ..... 2018-151739

(51) Int. Cl.
*G03G 15/02* (2006.01)
*G03G 15/06* (2006.01)
*G03G 15/16* (2006.01)

(52) U.S. Cl.
CPC ..... *G03G 15/0233* (2013.01); *G03G 15/065* (2013.01); *G03G 15/1685* (2013.01)

(58) Field of Classification Search
CPC ..... G03G 15/08
See application file for complete search history.

(56) References Cited

U.S. PATENT DOCUMENTS

| | | | | |
|---|---|---|---|---|
| 5,502,552 | A | 3/1996 | Iwata et al. | |
| 9,091,963 | B2 | 7/2015 | Matsushita | |
| 9,098,010 | B2 * | 8/2015 | Koyanagi | G03G 15/0818 |
| 2001/0048828 | A1 * | 12/2001 | Ishii | G03G 9/0825 399/281 |
| 2011/0170884 | A1 | 7/2011 | Yamane et al. | |
| 2013/0344427 | A1 * | 12/2013 | Kadota | G03G 21/0029 430/105 |
| 2015/0055988 | A1 | 2/2015 | Goto et al. | |

FOREIGN PATENT DOCUMENTS

| | | | |
|---|---|---|---|
| JP | H07-13410 | A | 1/1995 |
| JP | H07-28366 | A | 1/1995 |
| JP | 09288404 | A | * 11/1997 |
| JP | H10-133469 | A | 5/1998 |
| JP | 2011-145486 | A | 7/2011 |
| JP | 2011-257708 | A | 12/2011 |
| JP | 2015-041085 | A | 3/2015 |

* cited by examiner

*Primary Examiner* — Walter L Lindsay, Jr.
*Assistant Examiner* — Milton Gonzalez
(74) *Attorney, Agent, or Firm* — Venable LLP

(57) ABSTRACT

A process cartridge includes a developer carrier including a dielectric portion and a conductive portion on a surface thereof, a regulation member, and an image carrier disposed so as to come into contact with the developer carrier. The developer carrier and the image carrier are rotationally driven such that a surface of the developer carrier and a surface of the image carrier move at linear velocities different from each other at a contact portion, and the developer remaining on the image carrier after the developer image is transferred from the image carrier, is collected by the developer carrier at the contact portion.

14 Claims, 11 Drawing Sheets

(COMPARATIVE EXAMPLE)

(COMPARATIVE EXAMPLE)

PROCESS CARTRIDGE AND IMAGE FORMING APPARATUS

BACKGROUND OF THE INVENTION

Field of the Invention

The present invention relates to a process cartridge that is used in an image forming apparatus forming an image on a recording medium, such as an electrophotographic printer and an electrophotographic copier, and to an image forming apparatus.

Description of the Related Art

A contact charging method is known for uniformly charging a surface of a photoreceptor drum by bringing a charging member into contact with the photoreceptor drum. In the contact charging method, in order to obtain a surface potential Vd of the photoreceptor drum necessary for formation of an electrostatic latent image, it is necessary to apply a direct-current (DC) voltage higher than the surface potential Vd to the charging member.

Meanwhile, in the contact charging method, a discharge phenomenon may occur in a minute gap between the photoreceptor drum and the charging member when the DC voltage is applied. A corona product, such as ozone and a nitrogen oxide (NOx), is more easily adhered to the surface of the photoreceptor drum as compared to a non-contact charging method because of the charge phenomenon that occurs in the minute gap in the contact charging method. As a result, the charge holding capacity on the surface of the photoreceptor drum deteriorates due to adhesion of foreign particles including the corona product on the surface of the photoreceptor drum, which often results in image defects.

To eliminate image defects caused by the corona product (adhered substance) on the photoreceptor drum, Japanese Patent Application Laid-Open No. 2011-257708 discusses a configuration for controlling temperature and humidity on the surface of the photoreceptor drum by a heater, a fan, etc.

Japanese Patent Application Laid-Open No. 07-028366 discusses a configuration in which a corona-product removing member is brought into contact with the photoreceptor drum to remove corona products when image formation is not being executed.

Japanese Patent Application Laid-Open No. 2011-145486 describes a configuration in which a cleaning member is provided in the photoreceptor drum, and discusses a technique of controlling the photoreceptor drum to perform idle rotation to remove adhered substances from the surface of the photoreceptor drum when image formation is not being executed.

In the case of the configuration discussed in Japanese Patent Application Laid-Open No. 2011-257708 or No. 07-028366, however, it is necessary to provide a heater, a fan, or a particular member (configuration) to remove the corona products, which causes issues such increasing the size and cost of an apparatus. In the case of the technique discussed in Japanese Patent Application Laid-Open No. 2011-145486, it is necessary to provide dedicated time (process) for cleaning the surface of the photoreceptor drum, which leads to increasing downtime. In particular, only small amounts of corona products are removed in apparatuses in which the cleaning member is not provided on the photoreceptor drum (e.g., cleaner-less configuration).

SUMMARY OF THE INVENTION

The present invention may relate to a process cartridge and an image forming apparatus that make it possible to minimize downtime and to reduce adhesion of corona products on a surface of an image carrier without separately providing a cleaning member.

According to an aspect of the present invention, a process cartridge includes (i) a developer carrier configured to include, on a surface thereof, a conductive portion having electrical conductivity and a dielectric portion higher in electric resistance than the conductive portion, and to carry developer, (ii) a regulation member configured to regulate a thickness of the developer carried by the developer carrier, and (iii) an image carrier configured to come into contact with the developer carrier and to carry a developer image formed with the developer. The developer carrier and the image carrier are rotationally driven such that a surface of the developer carrier at a contact portion contacting the image carrier and a surface of the image carrier at the contact portion move at linear velocities different from each other. The developer remaining on the image carrier after the developer image is transferred from the image carrier, is collected by the developer carrier at the contact portion.

According to another aspect of the present invention, an image forming apparatus includes the process cartridge and a transfer member configured to transfer the developer image carried by the image carrier onto a recording medium.

Further features of the present invention will become apparent from the following description of exemplary embodiments with reference to the attached drawings.

DESCRIPTION OF THE EMBODIMENTS

An exemplary embodiment of the present invention can be implemented as a process cartridge or an image forming apparatus.

An electrophotographic image forming apparatus using a process cartridge according to the exemplary embodiment of the present invention is described below with reference to the attached drawings. While the exemplary embodiment described below illustrates the present invention, dimensions, materials, shapes, relative positional relationship, etc. of components described below do not limit the scope of the present invention, unless otherwise noted especially.

The electrophotographic image forming apparatus forms an image on a recording medium with use of an electrophotographic image forming method. Examples of the electrophotographic image forming apparatus include an electrophotographic copier, an electrophotographic printer (e.g., laser beam printer and light-emitting diode (LED) printer), a facsimile apparatus, and a word processor.

The process cartridge is obtained by integrating a charging unit, a developing unit, or a cleaning unit with an electrophotographic photoreceptor drum into a cartridge, and is detachable to a main body of the electrophotographic image forming apparatus. Further, the process cartridge is obtained by integrating at least one of the charging unit, the developing unit, and the cleaning unit with the electrophotographic photoreceptor drum into a cartridge, and is detachable to the main body of the electrophotographic image forming apparatus. Furthermore, the process cartridge is obtained by integrating at least the developing unit with the electrophotographic photoreceptor drum into a cartridge, and is detachable to the main body of the electrophotographic image forming apparatus.

<Image Forming Apparatus>

First, an exemplary embodiment of the present invention (hereinafter referred to as a present exemplary embodiment) including (1) an entire configuration, (2) a configuration of each of control units, and (3) an image forming process of the electrophotographic image forming apparatus (hereinafter, referred to as an "image forming apparatus") will now be described with reference to FIG. 2 and FIG. 3.

Figure 2:
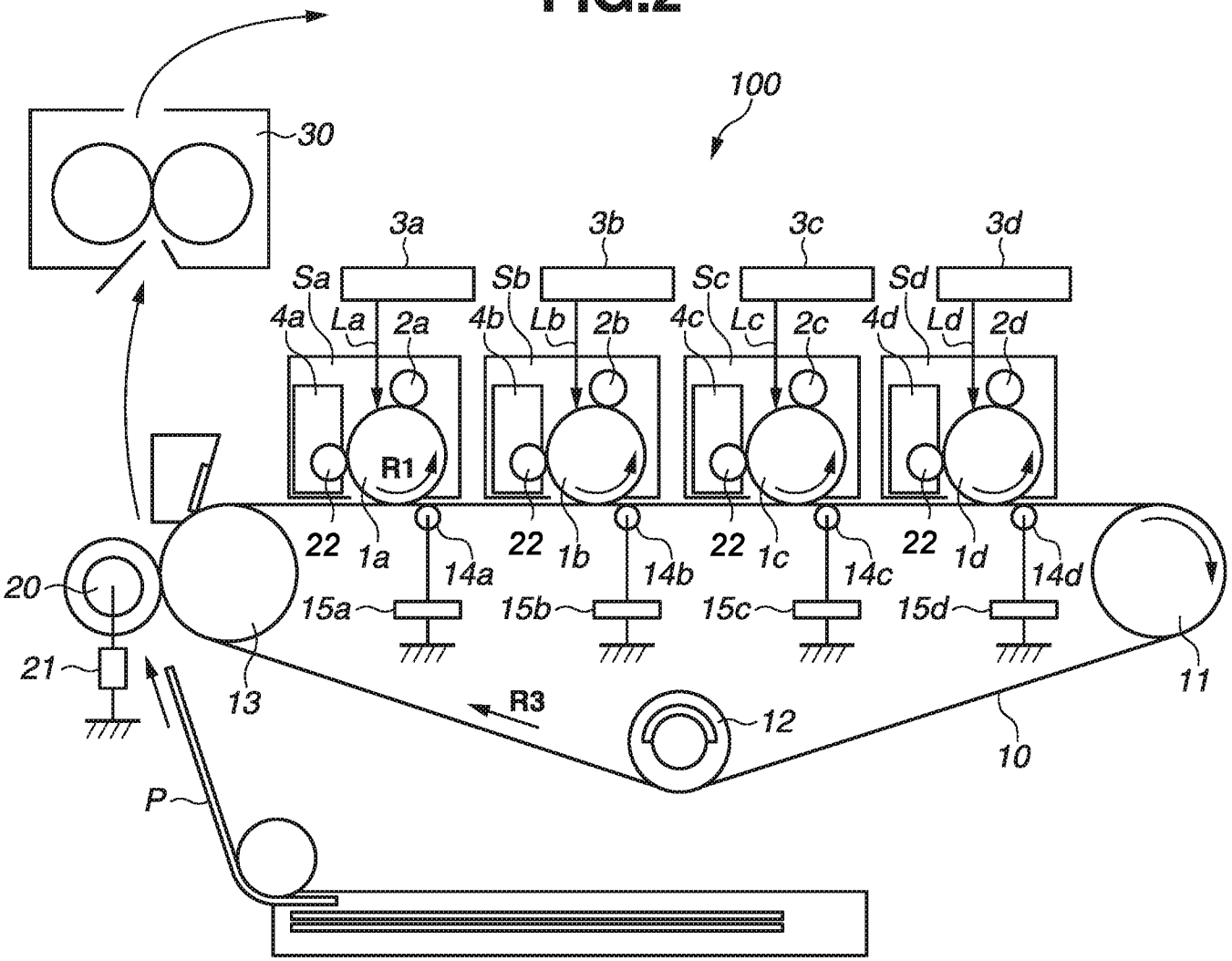
FIG. 2 is a schematic diagram illustrating a cross-section of an image forming apparatus using the process cartridge according to the exemplary embodiment of the present invention.

FIG. 2 is a schematic diagram illustrating a cross-section of the image forming apparatus using the process cartridge according to the present exemplary embodiment. FIG. 3 is a diagram illustrating a configuration of a control unit in the image forming apparatus using the process cartridge according to the present exemplary embodiment.

(1) Entire Configuration

As illustrated in FIG. 2, in the present exemplary embodiment, an image forming apparatus 100 is a full-color laser printer adopting an inline method and an intermediate transfer method. The image forming apparatus 100 can form a full-color image on a recording medium P (e.g., recording paper or plastic sheet) based on image information. The image information is input to the image forming apparatus 100 from an image reading apparatus or a host apparatus (such as a personal computer) connected to communicate with the image forming apparatus 100.

The image forming apparatus 100 includes, as a plurality of image forming units, first, second, third, and fourth process cartridges Sa, Sb, Sc, and Sd to form images of colors of yellow (Y), magenta (M), cyan (C), and black (K), respectively. In the present exemplary embodiment, the first to fourth process cartridges Sa, Sb, Sc, and Sd are arranged in line in a direction intersecting a vertical direction (for example, a horizontal direction).

In the present exemplary embodiment, the configurations and operations of the first to fourth process cartridges Sa, Sb, Sc, and Sd are substantially the same except for a color of an image to be formed. Accordingly, in a case where distinction is not particularly necessary in the following description, configurations are comprehensively described while suffixes a, b, c, and d, which are each appended to a reference numeral to indicate an element for each color, are omitted.

In the present exemplary embodiment, the image forming apparatus 100 includes, as a plurality of image carriers, four drum-shaped electrophotographic photoreceptors arranged side by side in the direction intersecting the vertical direction. In other words, the image forming apparatus 100 includes a photoreceptor drum 1 (1*a*, 1*b*, 1*c*, and 1*d*). The photoreceptor drum 1 is rotationally driven by a driving unit (driving source) (not illustrated).

A charging roller 2 (2*a*, 2*b*, 2*c*, and 2*d*), a scanner unit (exposure device) 3 (3*a*, 3*b*, 3*c*, and 3*d*), and a developing unit 4 (4*a*, 4*b*, 4*c*, and 4*d*) are disposed around the photoreceptor drum 1.

The charging roller 2 is a charging unit that uniformly charges the surface of the photoreceptor drum 1. The scanner unit 3 is an exposure unit that radiates laser beams to form an electrostatic image (electrostatic latent image) on the photoreceptor drum 1, based on an output calculated by a central processing unit (CPU) (not illustrated) from the image information provided from the host apparatus (e.g., personal computer).

The developing unit 4 develops the electrostatic image as a developer image formed of developer (hereinafter, toner T).

The photoreceptor drum 1, the charging roller 2 as a process unit acting on the photoreceptor drum 1, and the developing unit 4 are integrated to form a process cartridge S. The process cartridge S is attachable to and detachable from the image forming apparatus 100 via an attachment unit, such as an attachment guide and a positioning member, provided in the image forming apparatus 100.

Further, an intermediate transfer belt 10 as an intermediate transfer member that transfers the toner image formed on the photoreceptor drum 1 onto the recording medium P is disposed to face the photoreceptor drum 1 (1*a*, 1*b*, 1*c*, and 1*d*). The intermediate transfer belt 10, which is formed as an endless belt, comes into contact with the photoreceptor drum 1 (1*a*, 1*b*, 1*c*, and 1*d*), and is circularly moved (rotated) in a direction of an arrow R3 (clockwise direction) illustrated in FIG. 2. The intermediate transfer belt 10 is stretched over a plurality of supporting members, i.e., a secondary transfer counter roller 13, a driving roller 11, and a tension roller 12.

A primary transfer roller 14 (14*a*, 14*b*, 14*c*, and 14*d*) as a primary transfer unit is disposed on the inner peripheral surface side of the intermediate transfer belt 10 so as to face the photoreceptor drum 1. The four primary transfer rollers 14*a*, 14*b*, 14*c*, and 14*d* are arranged side by side. The primary transfer roller 14 presses the intermediate transfer belt 10 against the photoreceptor drum 1 to form a primary transfer portion at which the intermediate transfer belt 10 and the photoreceptor drum 1 come into contact with each other.

Further, a secondary transfer roller 20 as a secondary transfer unit is disposed at a position facing the secondary transfer counter roller 13 on the outer peripheral surface side of the intermediate transfer belt 10. The secondary transfer roller 20 is brought into pressure-contact with the secondary transfer counter roller 13 via the intermediate transfer belt 10, to form a secondary transfer portion at which the intermediate transfer belt 10 and the secondary transfer counter roller 13 contact each other.

The recording medium P onto which the toner image has been transferred is conveyed to a fixing device 30 as a fixing unit. The fixing device 30 applies heat and pressure to the recording medium P to fix the toner image on the recording medium P.

The image forming apparatus 100 can form a single-color image with use of only one desired image forming unit or form a multi-color image with use of some or all of the image forming units.

In the present exemplary embodiment, the image forming apparatus 100 is a printer that can handle a sheet of A4 size at process speed of 148.2 mm/sec.

(2) Configuration of Each of Control Units

Configurations of control units including a controller 200 that controls the entire image forming apparatus will now be described with reference to FIG. 3.

Figure 3:
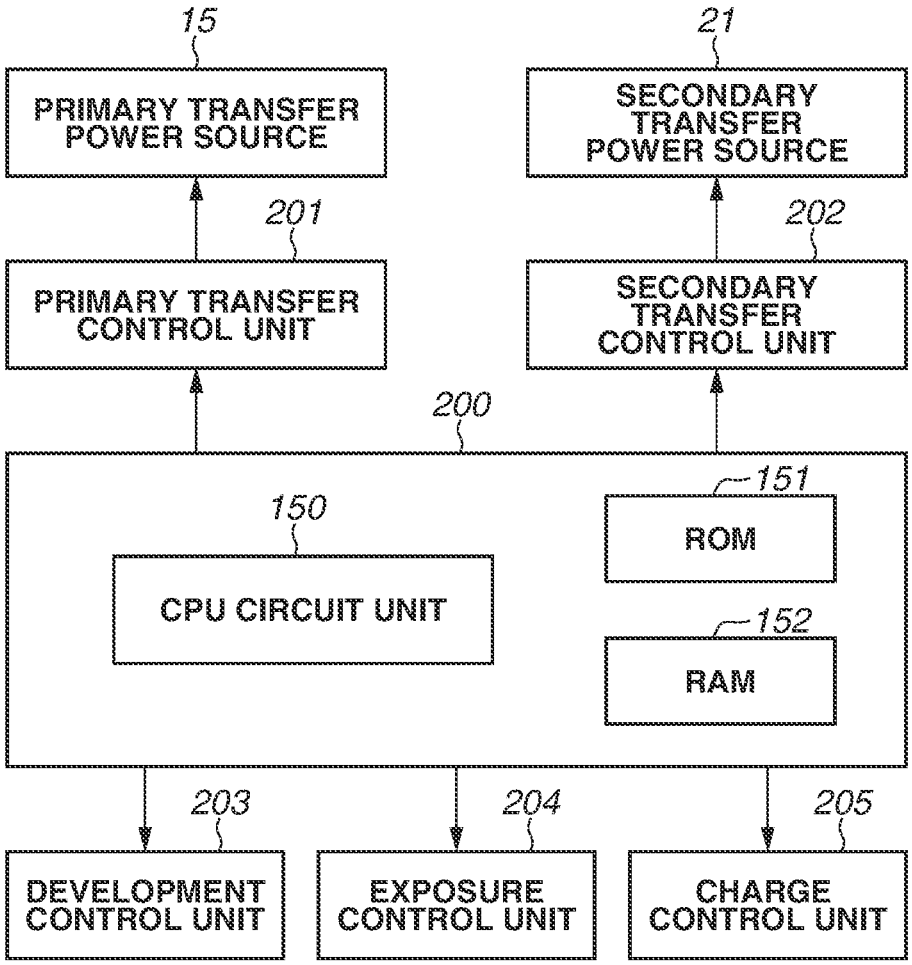
FIG. 3 is a diagram illustrating a configuration of a control unit in the image forming apparatus using the process cartridge according to the exemplary embodiment of the present invention.

As illustrated in FIG. 3, the controller 200 incorporates a central processing unit (CPU) circuit unit 150, a read-only memory (ROM) 151, and a random access memory (RAM) 152. The CPU circuit unit 150 controls a primary transfer control unit 201, a secondary transfer control unit 202, a development control unit 203, an exposure control unit 204, and a charge control unit 205 based on control programs stored in the ROM 151.

An environment table and a supportable sheet thickness table are stored in the ROM 151, and these tables are called and read by the CPU. The RAM 152 temporarily holds control data and is used as a work area for calculation processing accompanied by execution of the control. The primary transfer control unit 201 and the secondary transfer control unit 202 respectively control a primary transfer power source 15 (15*a*, 15*b*, 15*c*, and 15*d*) and a secondary transfer power source 21 to respectively control a voltage output from the primary transfer power source 15 and a voltage output from the secondary transfer power source 21 based on a current value detected by a current detection circuit (not illustrated).

Upon receipt of the image information and a print instruction from the host computer (not illustrated), the controller 200 controls the control units (i.e., the primary transfer control unit 201, the secondary transfer control unit 202, the development control unit 203, the exposure control unit 204, and the charge control unit 205) to execute an image forming operation necessary for a print operation.

(3) Image Forming Process

An image forming process using the image forming apparatus according to the present exemplary embodiment is described below.

In the image forming process, the surface of the photoreceptor drum 1 is first uniformly charged by the charging roller 2.

Next, based on the output calculated by the CPU from the image information input from the host apparatus, the charged surface of the photoreceptor drum 1 is scanned and exposed by a laser beam emitted from the scanner unit 3 to form an electrostatic image on the photoreceptor drum 1 based on the image information.

Next, the electrostatic image formed on the photoreceptor drum 1 is developed as a toner image by the developing unit 4.

Thereafter, a voltage of a polarity opposite to the normal charging polarity of the toner is applied to the primary transfer roller 14 from the primary transfer power source 15 (high-voltage power source) as a primary transfer voltage application unit. As a result, the toner image on the photoreceptor drum 1 is primarily transferred onto the intermediate transfer belt 10. In formation of a full-color image, the above-described process is sequentially performed by each of the first to fourth process cartridges Sa, Sb, Sc, and Sd, and the toner images of the respective colors are then primarily transferred to the intermediate transfer belt 10 so as to be superimposed on one another.

Thereafter, the recording medium P is conveyed to the secondary transfer unit in synchronization with movement of the intermediate transfer belt 10.

A voltage of a polarity opposite to the normal charging polarity of the toner is applied to the secondary transfer roller 20 from the secondary transfer power source 21 (high-voltage power source) as a secondary transfer voltage application unit. As a result, the toner images of four colors formed on the intermediate transfer belt 10 are secondarily transferred to the recording medium P conveyed by a feeding unit in a collective manner by action of the secondary transfer roller 20 in contact with the intermediate transfer belt 10 via the recording medium P.

The recording medium P onto which the toner images have been transferred is conveyed to the fixing device 30 as the fixing unit. The fixing device 30 applies heat and pressure to the recording medium P to fix the transferred toner images, and the recording medium P is then discharged from the image forming apparatus 100.

The developing unit 4 performs reversal development by bringing the developing roller 22 (described below) serving as a developer carrier into contact with the photoreceptor drum 1 with a (linear) velocity difference, in order to control a development amount of the toner T. In other words, the developing unit 4 that develops the electrostatic images by causing the toner charged to the polarity (negative polarity in present exemplary embodiment) the same as the charging polarity of the photoreceptor drum 1 to adhere to a portion (image portion or exposed portion) on the photoreceptor drum 1 where the electric charge is attenuated by exposure is used.

The untransferred toner remaining on the surface of the photoreceptor drum 1 in the primary transfer process is collected by the developing roller 22 described below, and is reused. The untransferred toner remaining on the surface of the photoreceptor drum 1 in the primary transfer process is charged to the normal charging polarity while passing through the charging roller 2. Thereafter, the untransferred toner is collected by the developing roller 22 with use of an electric field generated by a potential difference between a potential of the photoreceptor drum 1 formed by the charging roller 2 and a potential of the developing roller 22 formed by application of a direct-current voltage, and is reused.

<Configuration of Process Cartridge>

The configuration of the process cartridge S mounted on the image forming apparatus 100 according to the present exemplary embodiment will now be described.

In the present exemplary embodiment, each of the process cartridges S for respective colors has the same shape except for an unillustrated identification unit. The toner of yellow (Y), magenta (M), cyan (C), or black (K) is contained in the developing unit 4 of the process cartridge S for the corresponding color.

In the present exemplary embodiment, the developing unit 4 uses non-magnetic single-component toner as a developer.

The process cartridge S is configured by integrating a photoreceptor unit that includes the photoreceptor drum 1 and the rotatable charging roller 2, and a developing unit (developing device) 4 including the rotatable developing roller 22.

The photoreceptor drum 1 is rotatably supported by a bearing (not illustrated). The photoreceptor drum 1 is rotationally driven in a direction (counterclockwise direction) of an arrow R1 illustrated in FIG. 2 based on the image forming operation when driving force from the driving unit (driving source) (not illustrated) is transferred to the photoreceptor unit. A roller portion, made of a conductive rubber, of the charging roller 2 is brought into pressure-contact with the photoreceptor drum 1, and the charging roller 2 is driven to rotate as the photoreceptor drum 1 rotates.

Figure 4:
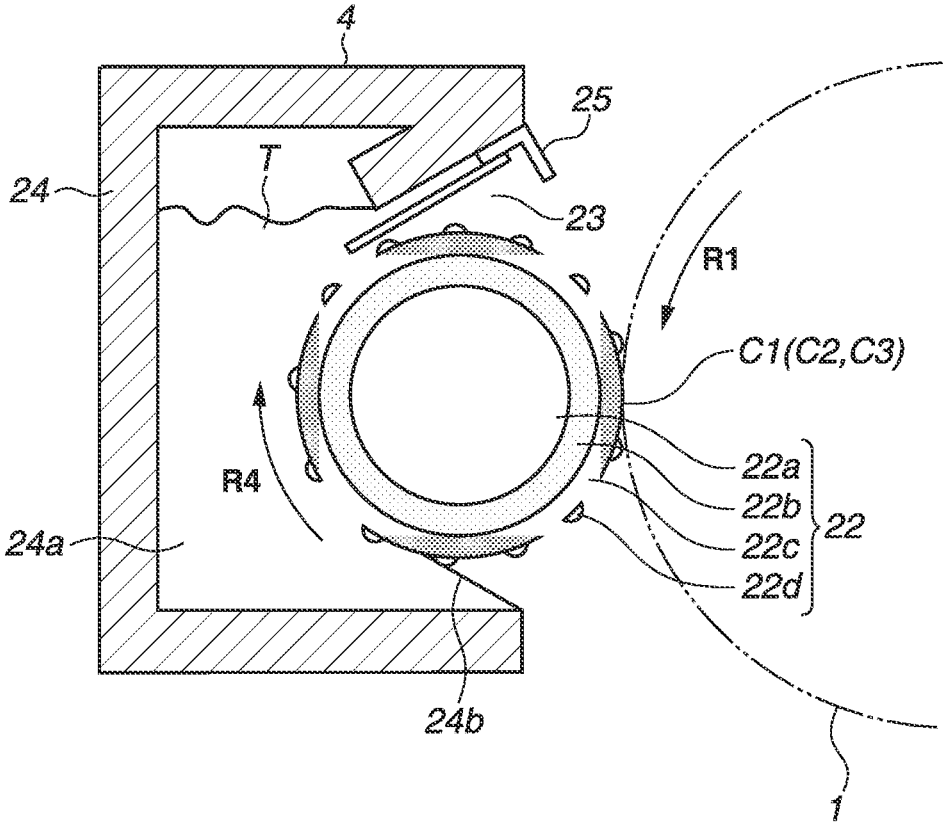
FIG. 4 is a schematic diagram illustrating a developing unit of the process cartridge according to the exemplary embodiment of the present invention.

Meanwhile, as illustrated in FIG. 4, the developing unit 4 includes the developing roller 22 that carries the toner T, the developing blade 23 (regulation member), and a developing frame 24 that fixes the developing roller 22 and the developing blade 23.

The developing frame 24 includes a developing chamber 24*a* in which the developing roller 22 is disposed, and a flow-out prevention sheet 24*b*. The flow-out prevention sheet 24*b* seals a developing opening that allows the developing chamber 24*a* to communicate with outside.

One end (fixed end) of the developing blade 23 is fixed by a fixing member 25 fixed to the developing frame 24, and the other end (free end) of the developing blade 23 is brought into contact with the developing roller 22 so as to regulate an amount of toner coating on the developing roller 22 and application of an electric charge.

The developing roller 22 is disposed at the developing opening so as to come into contact with the photoreceptor drum 1. Further, the developing roller 22 is rotationally driven in a direction of an arrow R4 illustrated in FIG. 4. Meanwhile, the photoreceptor drum 1 is rotationally driven in the direction of the arrow R1.

In the present exemplary embodiment, as illustrated in FIG. 4, the developing roller 22 and the photoreceptor drum 1 are rotationally driven such that a surface (C2) of the developing roller 22 and a surface (C3) of the photoreceptor drum 1 are moved in the same direction (in present exemplary embodiment, in direction from the upper side toward the lower side in the direction of gravity) at a facing portion (contact portion C1)). In addition, a predetermined direct-current voltage is applied as a developing bias to the developing roller 22. Further, the electrostatic latent image on the photoreceptor drum 1 is visualized by the toner negatively charged (changed to the negative polarity) by triboelectric charging at a developing portion (contact portion) where the developing roller 22 comes into contact with the photoreceptor drum 1, and the toner image (developer image) is formed on the photoreceptor drum 1.

As illustrated in FIG. 4, the developing blade 23 is in contact with the developing roller 22 so as to be oriented in a direction that is counter to the rotation direction R4 of the developing roller 22, thereby regulating an amount of toner coating and application of an electric charge. In other words, the free end of the developing blade 23 extends on the upstream side in the rotation direction R4 of the developing roller 22 and is in contact with the surface of the developing roller 22.

Figure 5:
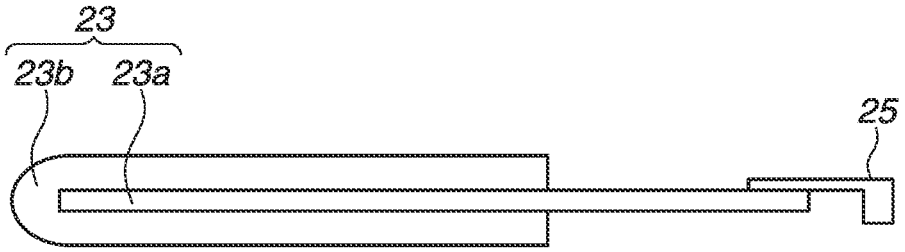
FIG. 5 is a schematic diagram illustrating a developing blade of the process cartridge according to the exemplary embodiment of the present invention.

In the present exemplary embodiment, as illustrated in FIG. 5, a supporting member 23*a* that is a plate spring made of stainless steel and having a thickness of 50 μm to 120 μm can be used as the developing blade 23. A surface of a blade portion 23*b* can be brought into contact with the developing roller 22 due to spring elasticity of the supporting member 23*a*. The blade portion 23*b* has a configuration in which one end (free end) is provided with the blade portion 23*b* and the other end (fixed end) is connected to and supported by the fixing member 25 fixed to the developing frame 24, in a widthwise direction of the developing blade 23.

The configuration of the developing blade 23 is not limited to the above-described configuration, and a thin plate made of metal, such as phosphor bronze and aluminum, may also be used as the supporting member 23*a* instead of the stainless steel plate. Further, the blade portion 23*b* may be formed by coating the surface of the supporting member 23*a* with a thin film made of a conductive resin, such as polyamide elastomer, urethane rubber, and a urethane resin. Alternatively, the supporting member 23*a* itself may be brought into contact with the developing roller 22 as the developing blade 23.

(1) Configuration and Manufacturing Method of Developing Roller

Figure 1A:
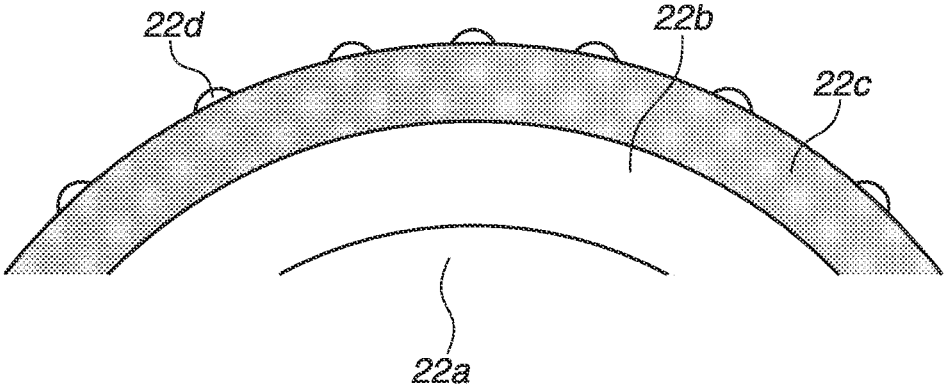
FIG. 1A is a schematic diagram illustrating a cross-section of a developing roller of a process cartridge according to an exemplary embodiment of the present invention.
Figure 1B:
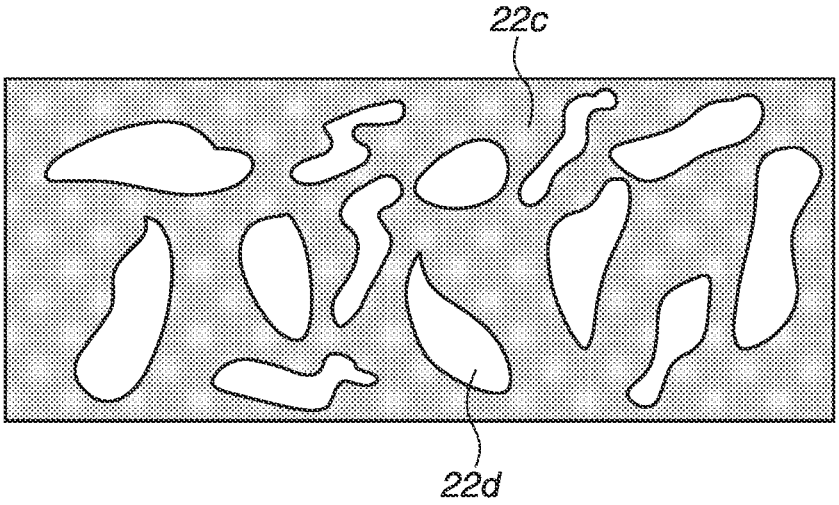
FIG. 1B is a planar diagram schematically illustrating a surface of the developing roller in an enlarged manner.

The developing roller 22 that is the most prominent feature of the present exemplary embodiment is described in detail below with reference to FIGS. 1A and 1B. FIG. 1A is a schematic diagram illustrating the cross section of the developing roller 22 of the process cartridge according to the present exemplary embodiment. FIG. 1B is a planar diagram schematically illustrating the surface of the developing roller 22 in an enlarged manner.

As illustrated in FIG. 1A, the developing roller 22 includes a base layer 22*b*, a surface layer 22*c*, and a dielectric portion 22*d* that are formed in this order on a surface of a metal core 22*a*.

In the present exemplary embodiment, the base layer 22*b* contains silicone rubber compositions illustrated in Table 1 below, and the surface layer 22*c* contains urethane illustrated in Table 2 below. The dielectric portion 22*d* is formed on the surface layer 22*c* by applying thereon an insulating coating material containing materials illustrated in Table 3 below. The surface layer 22*c* and the base layer 22*b* are grounded through the metal core 22*a*.

A manufacturing method, a material, a dimension, etc., of the developing roller 22 according to the present exemplary embodiment are described below.

(1-1) Metal Core 22*a*

The metal core 22*a* is fabricated by applying a primer (trade name: DY35-051, manufactured by Dow Corning Toray Co., Ltd.) on a core made of stainless steel SUS 304 (JIS) and having an outer diameter of 6 mm and a length of 259.9 mm, followed by heating at 150° C. for 20 minutes.

(1-2) Base Layer 22*b*

The base layer 22*b* is formed on the metal core 22*a* fabricated in (1-1). More specifically, the metal core 22*a* is inserted into a cylindrical mold with an inner diameter of 10.0 mm, and is disposed so as to be concentric with a cylinder of the mold.

As a formation material of the base layer 22*b*, a mixture obtained by mixing materials illustrated in Table 1 in a mixer (trade name: Tri-mix TX-15, manufactured by Inoue Mfg., Inc.), and then injecting the mixture into a mold heated to a temperature of 120° C. Thereafter, the mold is maintained at a temperature of 120° C. for 10 minutes to perform molding. The mold is cooled to ambient temperature, and demolding is then performed. The base layer 22*b* having a thickness of 2.00 mm is formed on an outer periphery of the metal core 22*a* in this manner.

TABLE 1

(constituent materials of base layer 22b)

| Constituent Material | Parts by Mass |
|---|---|
| Dimethylpolysiloxane having two or more silicon atom-bonded alkenyl groups in one molecule (trade name: SF3000E, viscosity: 10000 cP, vinyl group equivalent: 0.05 mmol/g, manufactured by KCC) | 100 |
| Dimethylpolysiloxane having two or more silicon atom-bonded hydrogen atoms in one molecule (trade name: SP6000P, Si—H group equivalent: 15.5 mmol/g, manufactured by KCC) | 0.5 |
| Platinum-based catalyst (trade name: SIP6832.2, manufactured by Gelest, Inc.) | 0.048 |
| Carbon black (trade name: TOKABLACK #7360SB, manufactured by TOKAI CARBON CO., LTD.) | 6 |

(1-3) Surface Layer 22c

The surface layer 22*c* is formed by applying a coating material forming the surface layer 22*c* on the surface of the base layer 22*b*. The coating material forming the surface layer 22*c* is prepared in the following manner.

A plurality of materials illustrated in Table 2 is weighed and mixed together by stirring, and the mixture is put into methyl ethyl ketone (manufactured by Sigma-Aldrich Co. LLC) and is stirred such that a solid content concentration of the mixture becomes 28 mass %. Further, the mixture is uniformly dispersed by a bead mill (Ashizawa Finetech Ltd.) to prepare the coating material.

The roller on which the base layer 22*b* has been formed is immersed into and is coated with a solution of the above-described coating material using an overflow-type circulation coating machine. As a result, a layer having a thickness of 15 μm is applied (formed) on the surface of the base layer 22*b*. Further, the coated roller is heated at 130° C. for 90 minutes to dry/cure the coated film. Thus, the surface layer 22*c* having elasticity is formed (laminated) on the base layer 22*b*.

TABLE 2

(constituent materials of surface layer 22c)

| Constituent Material | Parts by Mass |
|---|---|
| Acrylic polyol (trade name: PX41-11, manufactured by Asia Industry Co., Ltd.) | 67 |
| Isocyanate (trade name: DURANATE SBB-70P, manufactured by Asahi Kasei Corporation) | 33 |
| Carbon Black (trade name: MA100, manufactured by Mitsubishi Chemical Corporation) | 20 |
| Modified silicone oil (trade name: KF-410, manufactured by Shin-Etsu Chemical Co., Ltd.) | 1 |
| Resin particles (trade name: DAIMIC BEAZ UCN5150D, manufactured by Dainichiseika Color & Chemicals Mfg. Co., Ltd.) | 15 |

(1-4) Dielectric Portion 22d

The dielectric portion 22*d* is formed by applying a coating material forming the dielectric portion 22*d* on the surface of the surface layer 22*c*. The coating material forming the dielectric portion 22*d* is prepared in the following manner.

A plurality of materials illustrated in Table 3 is weighed and mixed together by stirring, and the mixture is put into methyl ethyl ketone (manufactured by Sigma-Aldrich Co. LLC) and is mixed such that a solid content concentration of the mixture becomes 3 mass %, to prepare the coating material. Next, the above-described coating material is applied by spray coating on the surface of the roller on which the surface layer 22*c* has been formed, such that the amount of the coating material becomes 0.040 g. Further, the coated roller is heated at 140° C. for 80 minutes to dry/cure the coated film. As a result, fabrication of the developing roller 22 in which the dielectric portion 22*d* is formed on the surface of the surface layer 22*c* is completed.

TABLE 3

(constituent materials of dielectric portion 22d)

| Constituent Material | Parts by Mass |
|---|---|
| Ester-based polyol (trade name: F1010, manufactured by Kuraray Co., Ltd.) | 60 |
| Isocyanate (trade name: VESTANAT BI370, manufactured by Degussa-Hüls AG) | 40 |

(2) Action of Force Received by Toner on Developing Roller (2-1) Action of Gradient Force As illustrated in FIG. 1B, the developing roller 22 fabricated by the above-described method has a configuration in which the dielectric portion 22*d* and the surface layer 22*c* (grounded via base layer 22*b* and metal core 22*a*) are irregularly mixed and distributed. When the developing blade 23 is rubbed against the surface of the developing roller 22 directly or via the toner T, a predetermined electric charge is applied to the dielectric portion 22*d* of the developing roller 22 (i.e., the dielectric portion 22*d* is charged).

An electric field is generated on the dielectric portion 22*d* provided with the electric charge. In particular, a minute closed electric field E is generated at an adjacent portion between the dielectric portion 22*d* and the surface layer 22*c* grounded via the metal core 22*a*, and a number of minute closed electric fields E are formed over the surface of the developing roller 22.

Figure 6:
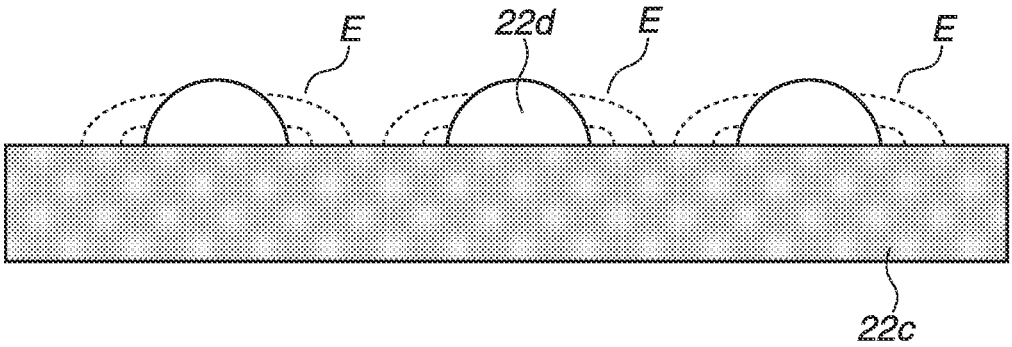
FIG. 6 is a schematic diagram illustrating a micro-electric field acting on a surface of the developing roller of the process cartridge according to the exemplary embodiment of the present invention.

For example, as illustrated in FIG. 6, when a dielectric portion 22*d* is charged by the blade 23 rubbing against the developing roller 22 via the toner T, a number of minute closed electric fields E each extending in an arc shape from the dielectric portion 22*d* to the surface layer 22*c* are formed. As a result, the charged toner T in the developing chamber 24*a* as well as the noncharged toner T or the low-charged toner T having an unstable charge amount are conveyed to a region where a number of minute closed electric fields E are generated on the developing roller 22.

The conveyed toner T receives electrostatic force generated by the electric field, or a gradient force (described below) generated by the minute closed electric field E in the case of the noncharged toner T, thereby being attracted to and carried on the surface of the developing roller 22.

The gradient force will now be described in detail with reference to FIGS. 7A and 7B.

Figure 7A:
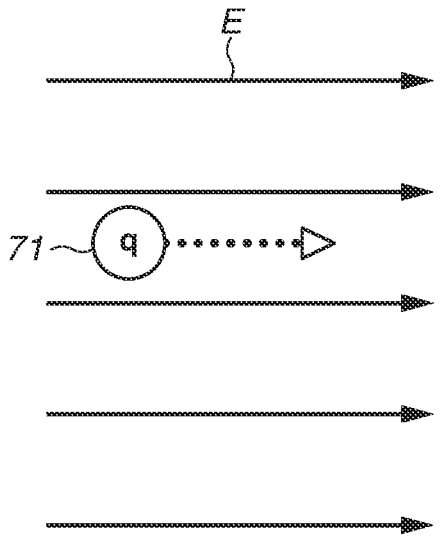
FIGS. 7A and 7B are schematic diagrams each illustrating action of gradient force on the surface of the developing roller of the process cartridge according to the exemplary embodiment of the present invention.
Figure 7B:
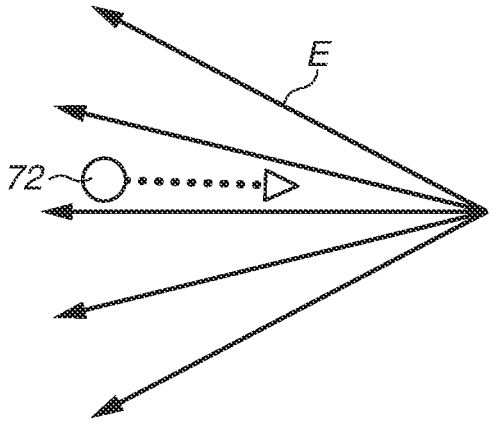

FIGS. 7A and 7B are schematic diagrams each illustrating action of the gradient force on the surface of the developing roller 22 of the process cartridge according to the present exemplary embodiment. In particular, FIGS. 7A and 7B each illustrate motion of a dielectric particle (developer particle) in the electric field.

As illustrated in FIG. 7A, in a case where a charged dielectric particle (toner particle) 71 is in the electric field provided from outside, the dielectric particle receives electrostatic force in a direction that is the same as or opposite to a direction of the electric field depending on the polarity (positive or negative) of the electrification charge.

As illustrated in FIG. 7B, in a case where a non-uniform electric field in which the electric intensity varies depending on position, a noncharged dielectric particle (toner particle) 72 in the non-uniform electric field receives a force directed to a region with high electric field intensity (rightward in FIG. 7B) even when though dielectric particle 72 does not have an electric charge. This force is the gradient force.

As described above, the toner T that is carried onto the developing roller 22 by electrostatic force or gradient force is regulated to a predetermined thickness by the developing blade 23 serving as the regulation member. At this time, the developing blade 23 is rubbed against (triboelectrically charges) the surface of the developing roller 22 through the toner T, thereby charging the toner T to the predetermined charge amount necessary for the developing operation in the polarity corresponding to the rank of each constituent material of each member in the triboelectric series. In other words, it is possible to stably carry, on the developing roller 22, the multilayer toner T in the predetermine adhesion amount and the predetermined charge amount.

Figure 8:
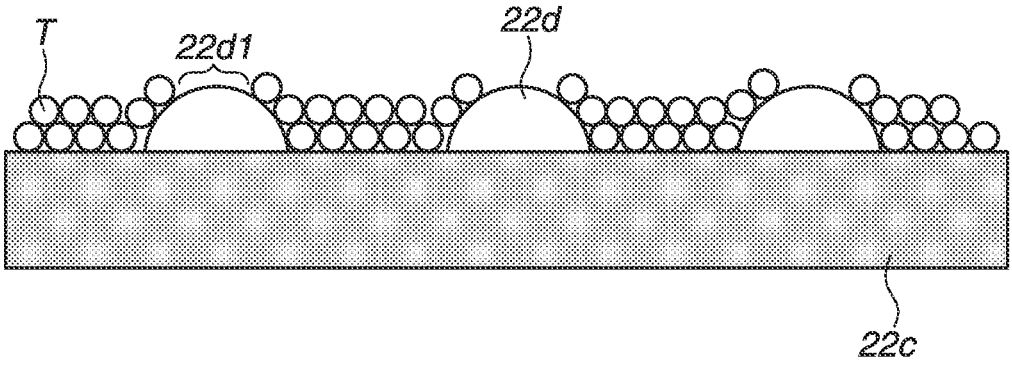
FIG. 8 is a schematic diagram illustrating a state where toner is adhered on the surface of the developing roller of the process cartridge according to the exemplary embodiment of the present invention.

In the case of the gradient force, the potential difference between the surface layer 22*c* and the dielectric portion 22*d* is increased and the intensity of the minute closed electric field E becomes high at a position closer to the region with high electric field intensity (i.e., boundary between surface layer 22*c* and dielectric portion 22*d*). Accordingly, a large amount of the toner T is conveyed to the vicinity of the boundary between the surface layer 22*c* and the dielectric portion 22*d*, and a relatively small amount of the toner T is conveyed to a region directly on the dielectric portion 22*d*. Therefore, as illustrated in FIG. 8, a region (exposed portion 22*d*1) where the toner T is not adhered is formed on the surface of the dielectric portion 22*d* of the developing roller 22.

Accordingly, the exposure portion can be constantly rubbed against the photoreceptor drum 1 by a rotating operation of the developing roller 22 in the normal image forming process (image forming operation). As a result, a foreign particle, such as a corona product, adhered on the photoreceptor drum 1 can be scraped off by the exposed portion of the developing roller 22. In other words, it is possible to suppress adhesion and accumulation of the corona product on the photoreceptor drum, and to accordingly reduce image defects caused by the corona product.

As described above, since the dielectric portion 22*d* on the developing roller 22 is easily exposed under the action of the gradient force, the corona product adhered on the photoreceptor drum 1 is easily scraped off by the dielectric portion 22*d* of the developing roller 22. This reduces issues such as image defects (image smearing) that can be caused by the corona product.

(2-2) Action of Gradient Force and Coulomb Force

The dielectric portion 22*d* or the developing blade 23 can be configured such that the charging polarity of the dielectric portion 22*d* becomes the same polarity as the normal charging polarity of the toner T when the developing blade 23 is rubbed against the dielectric portion 22*d* directly or via the toner T.

As described above, from the viewpoint of improvement of the ability (removability) to remove the corona product, it is desirable to expose the dielectric portion 22*d*. In a case where the charging polarity of the dielectric portion 22*d* is the same polarity as the charging polarity of the toner T, the toner T on the dielectric portion 22*d* tends to separate from the dielectric portion 22*d* due to not only the action of the gradient force generated by the minute closed electric field E, but also due to the "Coulomb force" (repulsive force) of the electric charge. Due to the action of the gradient force and the Coulomb force, it is possible to more fully expose the dielectric portion 22*d* from the toner T (i.e., form the exposed portion 22*d*1).

As a result, the dielectric portion 22*d* on the developing roller 22 can be more fully exposed, which enhances the ability to remove the corona product and thus more effectively suppresses image defects (image smearing) that can be caused by the corona product.

In the present exemplary embodiment, the developing blade 23 is rubbed against the dielectric portion 22*d* directly or via the toner T, which changes the charging polarity of the dielectric portion 22*d* to a negative polarity that is the same polarity as the normal charging polarity (negative polarity) of the toner T.

On the other hand, by the developing blade 23 rubbing against the dielectric portion 22*d* directly or via the toner T, the charging polarity of the dielectric portion 22*d* can also be changed to a positive polarity. In this case, the developing roller 22 can be fabricated in the following manner.

An elastic layer roller in which the surface layer 22*c* is formed on the developing roller 22 can be obtained in the above-described manner. Next, the mixture as illustrated in Table 3 (see paragraph 0079) is put into methyl ethyl ketone (manufactured by Sigma-Aldrich Co. LLC) and is stirred such that a solid content concentration of a styrene-acrylic resin (trade name: HITAROID HA-1470, manufactured by Hitachi Chemical Company, Ltd.) becomes 3 mass %, to thereby prepare the coating material.

Next, the coating material is applied to the surface of the roller, on which the surface layer 22*c* has been formed, by spray coating such that a coating amount of the coating material becomes 0.040 g. The resultant roller is then heated at 90° C. for 60 minutes to dry the coated film. As a result, fabrication of the developing roller 22 including, on the surface of the surface layer 22*c*, the dielectric portion 22*d* that can have a positive polarity when rubbed by the developing blade 23, is completed.

(3) Configuration to Enhance Gradient Force

Next, a configuration to further enhance the gradient force (electric field intensity) is described.

(3-1) Shape of Toner (Average Circularity)

As described above, a predetermined charging polarity (electric charge) is applied to the dielectric portion 22*d* on the developing roller 22 through rubbing by the developing blade 23 directly or via the toner T. Delivering and receiving of an electric charge (electrification) are promoted as the toner T easily rolls between the developing blade 23 and the dielectric portion 22*d* on the developing roller 22.

More specifically, chargeability with respect to the dielectric portion 22*d* is improved as each of particles of the toner T is closer to a spherical shape. In the present exemplary embodiment, it was confirmed that, in a case where an average circularity of the toner T particle is 0.97 or higher, the toner T can more easily rolls and the ability to apply an electric charge (chargeability) to the dielectric portion 22*d* is enhanced.

In contrast, in a case where the dielectric portion 22*d* is further charged, the minute closed electric field E can be formed with a higher intensity at the boundary between the dielectric portion 22*d* and the surface layer 22*c*. This makes it possible to expose a larger portion of the dielectric portion 22*d*.

Accordingly, the ability to remove the corona product by the exposed portion is improved, which makes it possible to effectively suppress image defect, such as image smearing, caused by adhesion of the corona product.

A method of measuring the average circularity of the toner particle will now be described.

The average circularity of the toner particle was measured by a flow particle image analyzer "FPIA-3000" (manufactured by Sysmex Corporation).

More specifically, after an appropriate amount of alkyl benzene sulfonate serving as a dispersant or a surfactant was added to 20 mL of ion exchange water, 0.02 g of a measurement sample was added to the resultant. A resultant mixture was subjected to dispersion treatment for two minutes, using a desktop ultrasonic cleaning and dispersing machine (e.g., "VS-150" (manufactured by VELVO-CLEAR)) that can operate at an oscillation frequency of 50 kHz and an electric output of 150 W, to prepare a dispersion liquid for measurement. At this time, the dispersion liquid was appropriately cooled such that the temperature thereof becomes 10° C. or more to 40° C. or less.

The measurement was performed using the above-described flow particle image analyzer on which a standard objective lens (×10) was mounted and a particle sheath "PSE-900A" (manufactured by Sysmex Corporation) was a sheath liquid. The prepared dispersion liquid was introduced into the flow particle image analyzer, and 3000 toner particles were measured in a total count mode of a HPF measurement mode. An average circularity of the toner particles was obtained while a binarization threshold in the particle analysis was set to 85%, and a particle diameter to be analyzed was limited to an equivalent circle diameter of 2.00 μm or more to 200.00 μm or less.

In the measurement, automatic focusing adjustment was performed with use of standard latex particles (e.g., "5200A" manufactured by Duke Scientific Corporation, which was diluted with ion exchange water) before start of the measurement. Thereafter, the focusing adjustment was performed every two hours from the start of the measurement.

In the present exemplary embodiment, a flow particle image analyzer that had been calibrated and had received a calibration certificate issued by Sysmex Corporation was used. The measurement was performed under the measurement and analysis conditions set when the calibration certificate was issued, except that the particle diameter to be analyzed was limited to an equivalent circle diameter of 2.00 μm or more to 200.00 μm or less.

The measurement principle of the flow particle image analyzer "FPIA-3000" (manufactured by Sysmex Corporation) lies in performing an image analysis based on a captured still image of flowing particles. A sample added to a sample chamber is feed to a flat sheath flow cell by a sample suction syringe.

The sample fed into the flat sheath flow cell is sandwiched by the sheath liquid to form flat flow. Strobe light is irradiated to the sample passing through the flat sheath flow cell at an interval of 1/60 seconds, which allows a still image of the flowing particles to be captured. Further, since the flow is flat, the image of the flowing particles is captured in a focused state. A particle image is captured by a charge-coupled device (CCD) camera, the captured image is subjected to image processing at image processing resolution of 512×512 (0.37 μm×0.37 μm per one pixel), a contour of each particle image is extracted, and a projection area, a circumferential length, etc., of each particle image are measured.

Next, a projection area S and a circumferential length L of each particle image are obtained. An equivalent circle diameter and circularity are obtained based on the area S and the circumferential length L. The equivalent circle diameter is a diameter of a circle having the area same as the projection area of each particle image. The circularity is defined as a value obtained by dividing the circumferential length of the circle obtained from the equivalent circle diameter by the circumferential length of the projected particle image, and can be calculated by the following expression:

$$\text{Circularity } C=2\times(\pi\times S)^{0.5}/L.$$

When the particle image has a circular shape, the circularity becomes 1.000, and the circularity becomes small as unevenness of an outer periphery of the particle image increases. After the respective circularities of the particles are calculated, the circularity range of 0.200 to 1.000 is divided into 800 sections, and the average circularity is calculated based on the number of measured particles.

(3-2) Configuration of Developing Blade and Developing Blade Voltage

The gradient force (electric field intensity) can also be enhanced in a method of applying a voltage to the developing roller 22 and the developing blade 23 to adjust a potential difference therebetween other than the method of defining the average circularity of the toner.

As the developing blade 23, the supporting member 23*a*, which is a plate spring made of stainless steel having a thickness of 50 μm to 120 μm, can be used. The surface of the blade portion 23*b* can be brought into contact with the developing roller 22 due to the spring elasticity of the supporting member 23*a*. The surface of the supporting member 23*a* may be coated with a thin film containing a conductive resin such as polyamide elastomer, urethane rubber, and a urethane resin.

Alternatively, the supporting member 23*a* itself may serve as the developing blade 23 and be brought into contact with the developing roller 22. In this case, a conductive thin plate made of a metal such as phosphor bronze and aluminum may be used as the supporting member 23*a* instead of the stainless steel plate.

In the present exemplary embodiment, the developing roller 22 and the photoreceptor drum 1 are rotationally driven such that the respective surfaces (C2 and C3) thereof are moved at different linear velocities at the contact portion C1 of the developing roller 22 and the photoreceptor drum 1.

The toner T charged to the same polarity as the charging polarity of the photoreceptor drum 1 (negative polarity in present exemplary embodiment) is reversely developed. In other words, the voltage of the negative polarity is applied to the developing roller 22. The voltage of the negative polarity is the same as the normal charging polarity of the toner T, has an absolute value higher than a value of the voltage applied to the developing roller 22, and is also applied to the developing blade 23. As a result, a stronger electric charge is applied to the dielectric portion 22*d* due to the toner T triboelectrically charged by being rubbed and the electric charge injected from the developing blade 23 side.

The gradient force more strongly acts as the potential difference between the dielectric portion 22*d* and the surface layer 22*c* (grounded) becomes larger. Therefore, the exposure percentage of the dielectric portion 22*d* of the developing roller 22 is increased after the toner T is attracted by the gradient force. As a result, the ability to remove the corona product is improved, which makes it possible to effectively suppress image defects, such as image smearing caused by adhesion of the corona product.

In the present exemplary embodiment, the charging polarity of the dielectric portion 22*d* of the developing roller 22 is the negative. Further, a voltage Vdc applied to the developing roller 22 is −300 V, and a voltage Vb applied to the developing blade 23 is −500 V. Accordingly, a difference between the voltage Vdc applied to the developing roller 22 and the voltage Vb applied to the developing blade 23, i.e., ΔV (=Vb−Vdc), is −200 V.

The action to enhance the gradient force is increased as an absolute value of the voltage difference ΔV becomes larger; however, if the absolute value of the voltage difference ΔV exceeds 500 V, discharge starts in addition to the charge injection. Therefore, it is desirable that a voltage exceeding the voltage (potential) necessary for image formation not be applied to the developing roller 22.

In a case of the developing roller 22 in which the charging polarity of the dielectric portion 22*d* is the positive, applying the voltage to the developing roller 22 and the developing blade 23 such that the voltage difference ΔV becomes stronger on the positive polarity side similarly makes it possible to achieve the effect of enhancing the gradient force.

(4) Configuration to Enhance Removability Corona Product

Next, a description is given of the configuration that more effectively removes the corona product after the dielectric portion 22*d* is exposed.

As described above, to control the amount (developing amount) of the toner T moving to the photoreceptor drum 1, the developing roller 22 is rotationally driven at a surface moving velocity (linear velocity) different from the surface moving velocity of the photoreceptor drum 1 at the contact portion C1. The removability of the corona product is enhanced when the surface moving velocity (linear velocity) of the surface (C2) of the developing roller 22 is greater than the surface moving velocity (linear velocity) of the surface (C3) of the photoreceptor drum 1 at the contact portion C1.

For example, in a case where the rotation speed (linear velocity on surface) of the developing roller 22 is greater than the rotation speed (linear velocity on surface) of the photoreceptor drum 1, an area where the corona product can be removed in one dielectric portion 22*d* (as a unit) is increased. Therefore, more of the area of the dielectric portion 22*d* can be efficiently used.

In contrast, in a case where the rotation speed (linear velocity on the surface) of the developing roller 22 is less than the rotation speed (linear velocity on the surface) of the photoreceptor drum 1, the corona product is removed only from a smaller part in one dielectric portion 22*d* (as a unit) in the rotation direction. Therefore, after a certain amount of corona product is scraped, the corona product is more accumulated on the dielectric portion 22*d*, which makes it difficult to maintain the desired removability.

As described above, it is desirable that the rotation speed of the developing roller 22 be greater than the rotation speed of the photoreceptor drum 1 in order to enhance the removability of the corona product, which makes it possible to effectively suppress image defects, such as image smearing, caused by adhesion of the corona product.

In contrast, in a case where the rotation speed of the developing roller 22 is much greater than the rotation speed of the photoreceptor drum 1, or in a case where the rotation speed of the developing roller 22 is greater than the rotation speed of the photoreceptor drum 1 but the (linear) speed difference therebetween is extremely low, the desired effect is hardly achieved.

For example, in a case where the rotation speed of the developing roller 22 is much greater than the rotation speed of the photoreceptor drum 1, the thickness of the toner layer at the contact portion C1 of the developing roller 22 and the photoreceptor drum 1 is excessively increased. As a result, the dielectric portion 22*d* is buried in the toner T and the removability is deteriorated.

Further, in a case where the (linear) speed difference is extremely low, the desired removability sometimes cannot be achieved.

The inventors have confirmed by examination that the removability is effectively exerted when the rotation speed of the developing roller 22 falls in a range of from 110% to 250% (linear velocity ratio) of the rotation speed of the photoreceptor drum 1. In particular, to form a clear image, the range of 130% to 200% is more desirable. In the present exemplary embodiment, a peripheral speed ratio is set to 140%.

Other than the above-described configuration, when a length of the dielectric portion 22*d* in a direction orthogonal to the rotation direction is greater than a length in the direction orthogonal to the rotation direction of the charging roller 2 charging the photoreceptor drum 1, the corona product can be more effectively removed.

The corona product is generated at the contact portion of the charging roller 2 and the photoreceptor drum 1. Accordingly, if the length in the direction orthogonal to the rotation direction of the dielectric portion 22*d* exerting the removability is greater than the length of the charging roller 2 in the direction orthogonal to the rotation direction, the dielectric portion 22*d* can exert removability on the entire area where the corona product is generated. This makes it possible to further suppress occurrences of image defects, such as image smearing, that can occur at an end part of the image because of the corona product.

In the present exemplary embodiment, the length of the charging roller 2 and the length of the dielectric portion 22*d* in the direction (longitudinal direction) orthogonal to the rotation direction are 227.6 mm and 234.2 mm, respectively.

<Evaluation Experiment>

To confirm the effects of the present exemplary embodiment, an evaluation experiment was performed with use of the configuration according to the present exemplary embodiment and a configuration according to a comparative example.

The evaluation was performed using a Hewlett-Packard Color LaserJet Pro M452dw (manufactured by Hewlett-Packard Inc.) printer as the image forming apparatus 100, and CS-680 paper (manufactured by Canon Marketing Japan Inc.) as the recording medium P. A sheet passing test in which two sheets were intermittently fed was performed with use of 20,000 sheets in each of a low-temperature and low-humidity environment (15° C./10%), a normal-temperature and normal-humidity environment (23° C./50%), and a high-temperature and high-humidity environment (30° C./80%). Evaluation regarding whether image defects caused by the corona product had occurred was performed in the configuration according to the present exemplary embodiment and in the configuration according to the comparative example.

(1) Configuration According to Comparative Example

Figure 9:
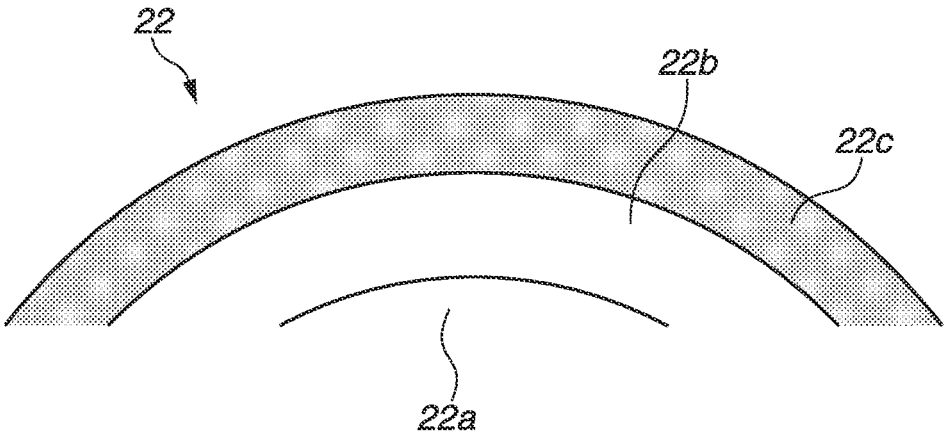
FIG. 9 is a cross-sectional view illustrating a developing roller of a process cartridge according to a comparative example of the present invention.

The developing roller 22 illustrated in FIG. 9 is used in the comparative example of the present exemplary embodiment.

The developing roller 22 according to the comparative example has a configuration in which a base layer 22*b* containing a silicone rubber composition illustrated in Table 1 described above and a surface layer 22*c* containing urethane illustrated in Table 2 described above are sequentially laminated on a metal core 22*a*. In the comparative example, the base layer 22*b* is grounded via the metal core 22*a*. The other configurations of the comparative example are similar to those of the present exemplary embodiment.

(2) Comparison of Evaluation Results Between Present Exemplary Embodiment and Comparative Example Table 4 illustrates comparison of evaluation results between the present exemplary embodiment and the comparative example.

"Good" in Table 4 indicates that image defects (image smearing) caused by the corona product were not observed before 20,000 sheets were fed. In contrast, "Not Good" indicates that image defects (image smearing) caused by the corona product were observed. A number in brackets indicates the number of sheets that had actually fed at the time when image defects were observed.

TABLE 4

| | Low-temperature and low-humidity environment | Normal-temperature and normal-humidity environment | High-temperature and high-humidity environment |
|---|---|---|---|
| Exemplary embodiment | Good | Good | Good |
| Comparative example | Good | Not Good (5000th sheet) | Not Good (1000th sheet) |

As illustrated in Table 4, occurrence of image defects (image smearing) caused by the corona product were not observed even after 20,000 sheets had passed in the configuration according to the present exemplary embodiment in any of the low-temperature and low-humidity environment, the normal-temperature and normal-humidity environment, and the high-temperature and high-humidity environment. This is because, as illustrated in FIG. 8, at least a part of the dielectric portion 22*d* is exposed as a result of the action of the gradient force, which causes the corona product on the photoreceptor drum to be effectively removed.

Figure 10:
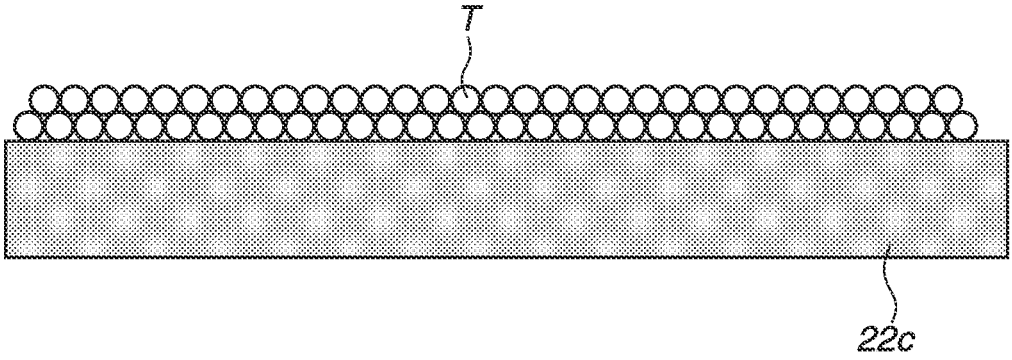
FIG. 10 is a diagram illustrating a state where toner is adhered on a surface of the developing roller of the process cartridge according to the comparative example of the present invention.
Figure 11:
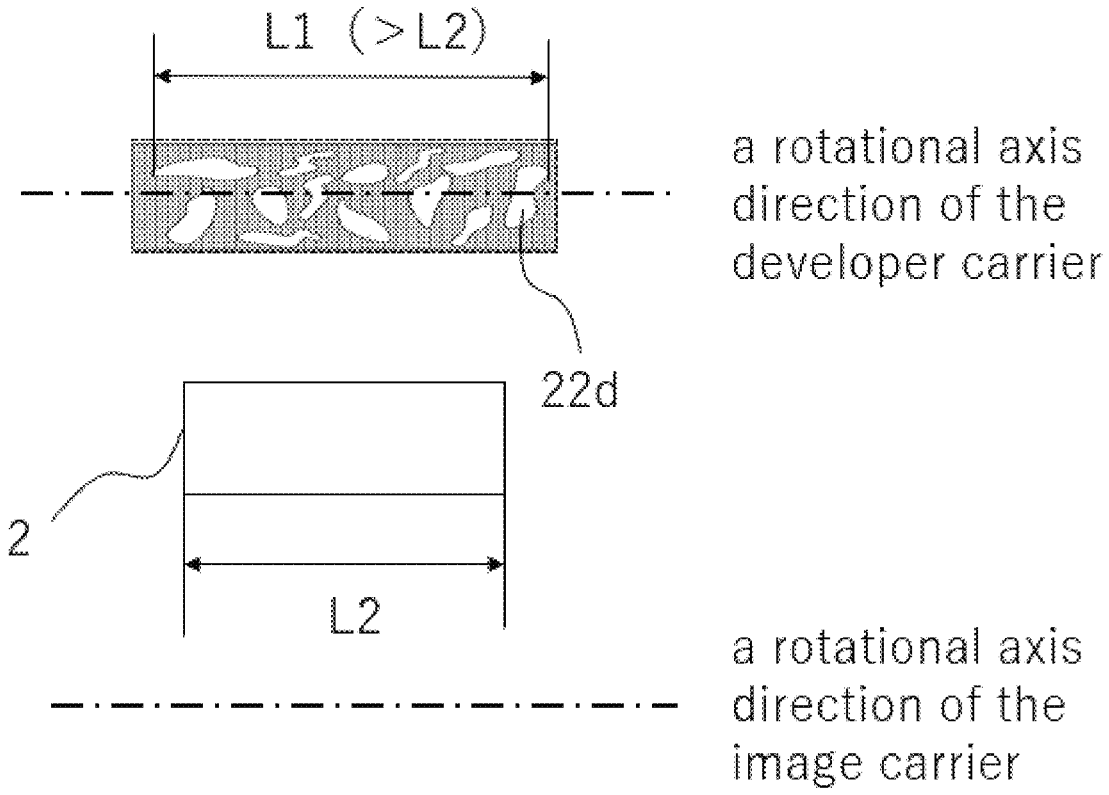
FIG. 11 is a schematic diagram illustrating a size relationship between a width of a region of the dielectric portion in a rotational axis direction of the developer carrier and a width of the charging member in a rotation axis direction of the image carrier.

In the configuration according to the comparative example, in contrast, as illustrated in FIG. 10 there is little exposed portion because the gradient force does not act on the developing roller 22. As a result, the corona product on the photoreceptor drum 1 cannot be removed with increase of the temperature and humidity, which accelerates generation of image defects (image smearing) caused by the corona product. More specifically, in the comparative example, although image defect was not observed before 20,000th sheets in the low-temperature and low-humidity environment, image defects were observed on about 5,000th sheet in the normal-temperature and normal-humidity environment, and on about 1,000th sheet in the high-temperature and high-humidity environment.

Accordingly, the configuration of the present exemplary embodiment can be summarized as follows.

The process cartridge according to the present exemplary embodiment includes a rotatable developer carrier configured to carry a developer. The developer carrier includes, on the surface thereof, a conductive portion having electroconductivity and a dielectric portion having a higher electric resistance than that of the conductive portion. The process cartridge according to the present exemplary embodiment further includes a regulation member configured to regulate a thickness of the developer carried by the developer carrier, and a rotatable image carrier configured to come into contact with the developer carrier and to carry a developer image formed by the developer.

In the present exemplary embodiment, the developer carrier and the image carrier are rotationally driven such that a surface C2 of the developer carrier and a surface C3 of the image carrier are moved at the contact portion C1 at linear velocities different from each other. At the contact portion C1, the developer remaining on the image carrier after the developer image is transferred from the image carrier is collected by the developer carrier.

With the above-described configuration according to the present exemplary embodiment, the exposed portion can be positively formed on the dielectric portion, thereby efficiently removing a substance adhered on the image carrier.

In the present exemplary embodiment, the developer carrier can include a matrix-domain structure in which one of the dielectric portion and the conductive portion forms a matrix and the other forms domains dispersed in the matrix. In particular, it is desirable that the conductive portion forms the matrix and that the dielectric portion desirably forms the domains. This makes it possible to more efficiently remove the substance adhered on the image carrier.

In the present exemplary embodiment, the dielectric portion can be configured to have a polarity that is the same as a normal charging polarity of the developer charged by friction with the regulation member on the surface of the developer carrier. This makes it possible to more effectively remove the substance adhered on the image carrier.

In the present exemplary embodiment, the normal charging polarity of the developer can be set to negative polarity.

In the present exemplary embodiment, it is desirable that a moving speed (linear velocity) on the surface of the developer carrier be higher than a moving speed (linear velocity) of the surface of the image carrier at the contact portion. In particular, at the contact portion, it is desirable that a ratio of the moving speed (linear velocity) of the surface of the developer carrier to the moving speed (linear velocity) of the surface of the image carrier falls in a range of from 110% to 250%. This makes it possible to more effectively remove the substance adhered on the image carrier.

In the present exemplary embodiment, it is desirable that an average circularity of developer particles is 0.97 or more. This makes it possible to more effectively charge the dielectric portion, and to further remove the substance adhered on the image carrier as a result.

The process cartridge according to the present exemplary embodiment includes a frame configured to rotatably support the developer carrier. Further, the regulation member includes a fixed end fixed to the frame and a free end opposite to the fixed end, and the free end of the regulation member can be brought into contact with the developer carrier. It is desirable that the free end of the regulation member be configured to extend from the fixed end toward the upstream side in a rotation direction of the developer carrier. This makes it possible to more effectively charge the dielectric portion, and to further remove the substance adhered on the image carrier as a result.

In the present exemplary embodiment, the regulation member may be configured such that a voltage is applied to the regulation member. In particular, it is desirable that a polarity of a voltage applied to the developer carrier for developing operation and a polarity of the voltage applied to the regulation member be the same as the normal charging polarity of the developer. This makes it possible to more effectively improve chargeability of the dielectric portion.

The process cartridge according to the exemplary embodiment further includes a charging member configured to charge the image carrier. Further, a width of a region where the dielectric portion is provided on the developer carrier in a rotational axis direction of the developer carrier, can be set greater than a width of the charging member in a rotation axis direction of the image carrier. As a result, a region where the corona product is generated is disposed in a region of the dielectric portion. This makes it possible to more effectively remove the adhered substance.

The process cartridge according to the present exemplary embodiment is attachable to and detachable from a main body of an image forming apparatus.

Further, an image forming apparatus according to the present exemplary embodiment includes the above-described process cartridge and a transfer member configured to transfer the developer image carried by the image carrier onto a recording medium.

According to the present exemplary embodiment, it is possible to easily remove the corona product (ozone and nitrogen oxide (NOx)) generated on the photoreceptor drum in the charging process, without separately providing a cleaning member for the photoreceptor drum or causing increase of the apparatus size, the cost, or the downtime. In other words, positively exposing a part (exposed portion) of the dielectric portion on the surface of the developer carrier causes the corona product on the photoreceptor drum to be effectively removed by the exposed portion, thereby effectively suppressing generation of image defect.

The present exemplary embodiment makes it possible to minimize downtime and to reduce adhesion of the corona product on the surface of the image carrier without separately providing the cleaning member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-151739, filed Aug. 10, 2018, which is hereby incorporated by reference herein in its entirety.

What is claimed is:

1. A process cartridge comprising:

a developer carrier configured to carry developer on a surface thereof, the developer carrier including a conductive portion having electrical conductivity and a dielectric portion higher in electric resistance than the conductive portion;

a regulation member configured to regulate a thickness of the developer carried by the developer carrier; and an image carrier configured to come into contact with the developer carrier and to carry a developer image formed of the developer, wherein the developer carrier and the image carrier are configured to be rotationally driven such that a surface of the developer carrier at a contact portion contacting the image carrier and a surface of the image carrier at the contact portion move at different linear velocities, wherein developer remaining on the image carrier after the developer image is transferred from the image carrier is collected by the developer carrier at the contact portion, wherein the cartridge is configured such that when a first voltage is applied to the developer carrier and a second voltage is applied to the regulation member, an exposed portion, which is not coated with the developer, is formed on the dielectric portion by applying the first voltage and the second voltage such that a difference between the second voltage and the first voltage has a polarity that is the same as a normal charging polarity of the developer.

2. The process cartridge according to claim 1, wherein the developer carrier includes a matrix-domain structure in which one of the dielectric portion and the conductive portion forms a matrix and the other forms domains dispersed in the matrix.

3. The process cartridge according to claim 2, wherein the conductive portion forms the matrix, and wherein the dielectric portion forms the domains.

4. The process cartridge according to claim 3, wherein the dielectric portion is configured to have a polarity that is the same as the normal charging polarity of the developer charged by friction with the regulation member on the surface of the developer carrier.

5. The process cartridge according to claim 4, wherein the normal charging polarity of the developer is a negative polarity.

6. The process cartridge according to claim 1, wherein, at the contact portion, the linear velocity of the surface of the developer carrier is greater than the linear velocity of the surface of the image carrier.

7. The process cartridge according to claim 6, wherein, at the contact portion, a ratio of the linear velocity of the surface of the developer carrier to the linear velocity of the surface of the image carrier falls in a range from 110% to 250%.

8. The process cartridge according to claim 1, wherein an average circularity of particles of the developer is 0.97 or more.

9. The process cartridge according to claim 1, further comprising a frame configured to rotatably support the developer carrier, wherein the regulation member includes a fixed end fixed to the frame and a free end which is opposite to the fixed end, and wherein the free end of the regulation member is configured to contact the developer carrier.

10. The process cartridge according to claim 9, wherein the free end of the regulation member is configured to extend from the fixed end toward an upstream side in a rotation direction of the developer carrier.

11. The process cartridge according to claim 1, wherein a polarity of the first voltage applied to the developer carrier and a polarity of the second voltage applied to the regulation member are both the same as the normal charging polarity of the developer.

12. The process cartridge according to claim 1, further comprising a charging member configured to charge the image carrier, wherein a width of a region where the dielectric portion is provided on the developer carrier in a rotational axis direction of the developer carrier is greater than a width of the charging member in a rotational axis direction of the image carrier.

13. The process cartridge according to claim 1, wherein the process cartridge is attachable to and detachable from a main body of an image forming apparatus.

14. An image forming apparatus, comprising:

the process cartridge according to claim 1; and a transfer member configured to transfer the developer image carried by the image carrier onto a recording medium.

* * * * *